US010124390B2

(12) United States Patent
Kohno

(10) Patent No.: US 10,124,390 B2
(45) Date of Patent: Nov. 13, 2018

(54) DIE CUSHION DEVICE AND CONTROL METHOD OF DIE CUSHION DEVICE

(71) Applicant: AIDA ENGINEERING, LTD., Kanagawa (JP)

(72) Inventor: Yasuyuki Kohno, Kanagawa (JP)

(73) Assignee: AIDA Engineering, Ltd., Kanagawa (JP)

( * ) Notice: Subject to any disclaimer, the term of this patent is extended or adjusted under 35 U.S.C. 154(b) by 729 days.

(21) Appl. No.: 14/855,170

(22) Filed: Sep. 15, 2015

(65) Prior Publication Data

US 2016/0074920 A1 Mar. 17, 2016

(30) Foreign Application Priority Data

Sep. 16, 2014 (JP) ..... 2014-188031

(51) Int. Cl.

*B21D 24/10* (2006.01)
*B21D 24/02* (2006.01)
*B21D 24/14* (2006.01)

(52) U.S. Cl.

CPC ..... *B21D 24/02* (2013.01); *B21D 24/10* (2013.01); *B21D 24/14* (2013.01)

(58) Field of Classification Search

CPC ..... B21D 24/10; B21D 24/14; B21D 24/02
USPC ..... 72/351, 453.13
See application file for complete search history.

(56) References Cited

U.S. PATENT DOCUMENTS 8,042,375 B2 * 10/2011 Suzuki ..... B21D 24/10 72/16.1
8,468,866 B2 * 6/2013 Miyasaka ..... B21D 24/02 72/351
8,757,056 B2 * 6/2014 Kohno ..... B21D 24/14 100/269.01
8,850,865 B2 * 10/2014 Miyasaka ..... B21D 24/10 72/351
2009/0025444 A1 1/2009 Suzuki
2009/0071218 A1 3/2009 Kohno et al.
2009/0158810 A1 6/2009 Kohno et al.

FOREIGN PATENT DOCUMENTS

JP 2006-142312 A 6/2006
JP 2006-315074 A 11/2006
JP 2011-098361 A 5/2011
WO 2006098256 A1 9/2006

OTHER PUBLICATIONS

Notification of Reasons for Refusal Japanese Patent Application No. 2014-188031 dated Apr. 12, 2016 with full English translation.

* cited by examiner

*Primary Examiner* — David B Jones
(74) *Attorney, Agent, or Firm* — McDermott Will & Emery LLP

(57) ABSTRACT

There are provided position controllers each of which controls a position of a cushion pad by controlling a hydraulic machine that supplies pressure oil to a die cushion pressure generation chamber of a hydraulic cylinder, and pressure controllers each of which controls pressure in the die cushion pressure generation chamber of the hydraulic cylinder, and in particular, during a rising process of a slide of a press machine, position control by the position controller and pressure control by the pressure controller are switched to enable press forming also during the rising process.

13 Claims, 6 Drawing Sheets

FIG.5
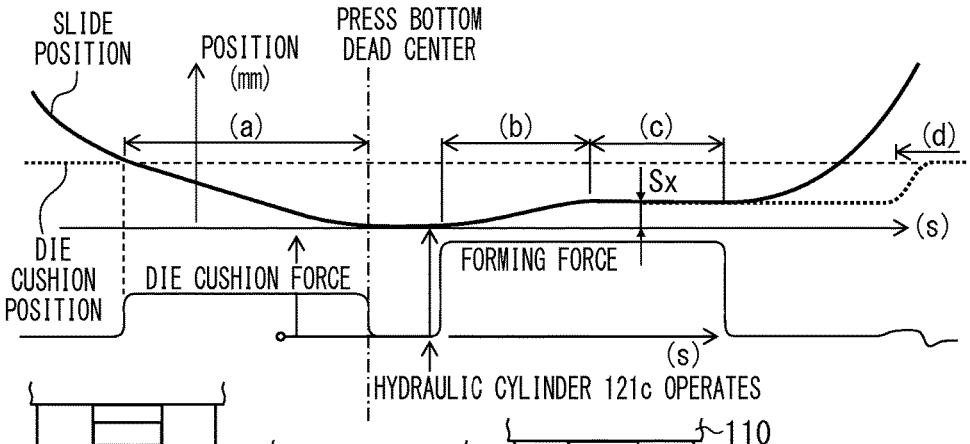
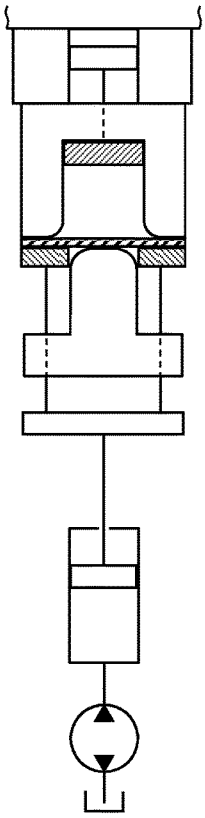
FIG.6A
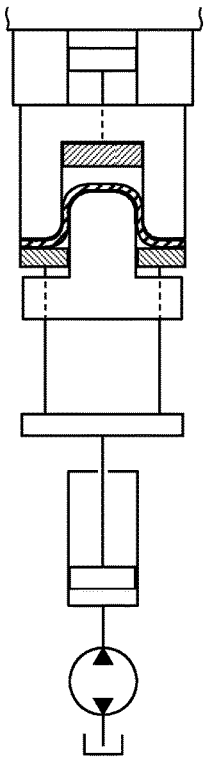
FIG.6B
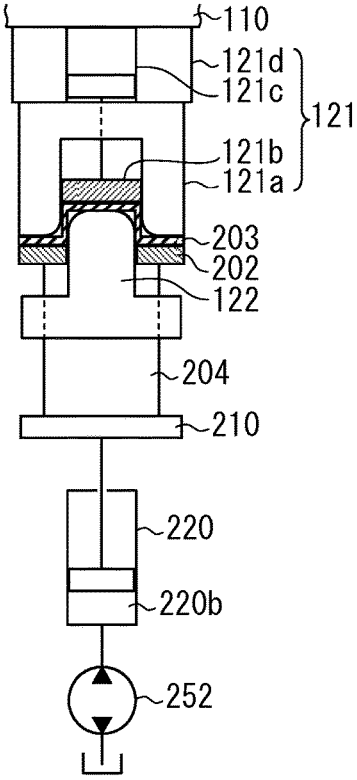
FIG.6C

DIE CUSHION DEVICE AND CONTROL METHOD OF DIE CUSHION DEVICE

CROSS-REFERENCE TO RELATED APPLICATIONS

This application claims priority to Japanese Patent Application No. 2014-188031 filed Sep. 16, 2014, the subject matter of which is incorporated herein by reference in entirety.

BACKGROUND OF THE INVENTION

Field of the Invention

The present invention relates to a die cushion device and a control method of the die cushion device, and more particularly to a die cushion device and a control method of the die cushion device in which a cushion pad is moved up and down by using a hydraulic cylinder.

Description of the Related Art

Heretofore, this kind of die cushion devices are described in Japanese Patent Application Laid-Open No. 2006-142312 and Japanese Patent Application Laid-Open No. 2006-315074.

The die cushion device described in Patent Application Laid-Open No. 2006-142312 is a typical hydraulic servo die cushion device in which die cushion force is generated by using a proportion flow control valve (servo valve), and is composed of very simple components in a system using a servo valve.

In a die cushion process, in a state where an electromagnetic changeover valve is turned off (closed), hydraulic oil displaced from a hydraulic cylinder interlocking with a cushion pad pressed down by a slide is (limitedly) throttled by opening of from an A-port (a port communicating with a lower chamber of a hydraulic cylinder) to a T-port (a port communicating with a tank) of a servo valve so that die cushion pressure is generated in the hydraulic cylinder.

In a rising process, in a state where the electromagnetic changeover valve is turned on (opened), opening of from a P-port (a port communicating with an accumulator side) to the A-port, and of from a B-port (a port communicating with an upper chamber of the hydraulic cylinder) to the T-port, of the servo valve, is adjusted to cause the hydraulic cylinder to rise by using energy of pressure oil accumulated in the accumulator.

At that time, in a normal rising process, pressure oil at a relatively low pressure required for knocking out a product (and pressure oil having low energy) is accumulated in the accumulator.

In addition, in the die cushion device described in Japanese Patent Application Laid-Open No. 2006-315074, a discharge port of a hydraulic pump/motor is directly connected to a lower chamber of a hydraulic cylinder supporting a cushion pad, and torque control is performed for an electric motor connected to a rotating shaft of the hydraulic pump/motor on the basis of a die cushion pressure command and pressure in the lower chamber of the hydraulic cylinder to enable pressure in the lower chamber of the hydraulic cylinder (die cushion pressure) to be arbitrarily controlled.

SUMMARY OF THE INVENTION

In Patent Application Laid-Open No. 2006-142312, although there is no description of press work that is performed during the rising process, if the press work is performed during the rising process, pressure oil at a high pressure (and pressure oil having high energy) has to be accumulated in the accumulator that supplies pressure oil to the hydraulic cylinder, in accordance with forming. In this case, it is required to increase capacity of the accumulator and a pressure oil supply source (a hydraulic pump and an electric motor) that supplies pressure oil at a high pressure to the accumulator.

In addition, since in each of the die cushion process and the rising process, pressure is controlled by throttling pressure oil using the servo valve to control the amount of oil, there is a large energy loss so that power cost and cooling cost (electricity cost) increase.

That is, also in the relatively simple servo die cushion device of a servo valve system described in Patent Application Laid-Open No. 2006-142312, in a case where forming requiring relatively large force is performed in the rising process, the die cushion device accompanies many problems, such as increase in capacity of a device, energy loss, and useless cycle time.

On the other hand, the die cushion device described in Japanese Patent Application Laid-Open No. 2006-315074 is capable of controlling die cushion pressure in quick response to a die cushion pressure command issued during the die cushion process, because the discharge port of the hydraulic pump/motor is directly connected to the lower chamber of the hydraulic cylinder, and torque control is performed for the rotating shaft of the hydraulic pump/motor by an electric motor to control hydraulic pressure in the lower chamber of the hydraulic cylinder (die cushion pressure). In Japanese Patent Application Laid-Open No. 2006-315074, however, there is no description of press forming that is to be performed during a rising process, and is no disclosure of an idea of performing press forming during each of the die cushion process (lowering process) and the rising process.

The present invention is made in light of the above-mentioned circumstances, and it is an object of the present invention to provide a die cushion device and a control method of the die cushion device, capable of achieving two times of press forming per one press cycle to improve efficiency of the press forming as well as to save energy, without resulting in an increase in size of a device and resulting in a high price of the device.

In order to achieve the object, a die cushion device in accordance with one aspect of the present invention includes: a cushion pad; a hydraulic cylinder that moves the cushion pad up and down; a hydraulic machine that supplies pressure liquid to a die cushion pressure generation chamber of the hydraulic cylinder; a die cushion position detector that detects a position of the cushion pad; a pressure detector that detects pressure in the die cushion pressure generation chamber of the hydraulic cylinder; a first command unit that outputs a first command showing a position of the cushion pad; a second command unit that outputs a second command showing pressure in the die cushion pressure generation chamber of the hydraulic cylinder or a physical amount in proportion to the pressure; a position controller that controls the hydraulic machine so as to cause the position of the cushion pad to correspond to the first command, on the basis of the first command outputted from the first command unit and the position of the cushion pad detected by the die cushion position detector; and a pressure controller that controls the hydraulic machine so as to cause the pressure in the die cushion pressure generation chamber of the hydraulic cylinder to correspond to the second command, on the basis of the second command outputted from the second command unit and the pressure detected by the pressure detector, and in the die cushion device, position control by the position controller and pressure control by the pressure controller are switched during a rising process of a slide of a press machine.

According to the one aspect of the present invention, there are provided the position controller that controls a position of the cushion pad by controlling the hydraulic machine that supplies pressure liquid to the die cushion pressure generation chamber of the hydraulic cylinder, and the pressure controller that controls pressure in the die cushion pressure generation chamber of the hydraulic cylinder, and in particular, during a rising process of the slide of the press machine, position control by the position controller and pressure control by the pressure controller are switched to enable press forming also during the rising process. In general, although position control of a cushion pad is performed to knock out a product after forming upward during the rising process, according to the present invention, the pressure control is also performed during the rising process to enable press forming during the pressure control.

In a die cushion device in accordance with another aspect of the present invention, the hydraulic machine enables force equivalent to die cushion force to be generated in the hydraulic cylinder during a rising process of the slide of the press machine. Accordingly, it is possible of perform forming also for a forming part that is made of a material with high tensile strength and is becoming a complicated shape, during the rising process.

In a die cushion device in accordance with yet another aspect of the present invention, it is preferable that there is provided a regenerative device that regenerates kinetic energy, energy required for die cushion force operation, or energy retained by pressure liquid of the hydraulic cylinder, during deceleration of the cushion pad in position control by the position controller, during pressure control by the pressure controller during descending, or during reduction in pressure in pressure control during a stop, through the hydraulic machine. Accordingly, it is possible to allow the die cushion device to have high energy efficiency to save energy.

In a die cushion device in accordance with yet another aspect of the present invention, it is preferable that position control by the position controller and pressure control by the pressure controller are switched during a lowering process of a slide of a press machine. For example, it is preferable that the position control is performed for the cushion pad until impact of the slide or just before the impact, and control is switched to the pressure control after the impact.

In a die cushion device in accordance with yet another aspect of the present invention, it is preferable that during a rising process of a slide of a press machine, the pressure controller performs pressure control at least during rising operation of the slide. The pressure control is performed during the rising process of the slide so that an outer side surface of a product is pulled upward by frictional force between an inner side surface of an upper die that is rising and the outer side surface of the product as well as an inner side surface of the product is pulled downward by frictional force between an outer side surface of a lower die and the inner side surface of the product to enable the product to be favorably deformed.

In a die cushion device in accordance with yet another aspect of the present invention, it is preferable that the hydraulic machine includes a hydraulic pump/motor whose discharge port is connected to the die cushion pressure generation chamber of the hydraulic cylinder through piping, and a driving device that selectively transmits rotational driving force in a normal rotation direction or a reverse rotation direction to a drive shaft of the hydraulic pump/motor. Since it is possible to selectively transmit the rotational driving force in the normal rotation direction or the rotational driving force in the reverse rotation direction to the drive shaft of the hydraulic pump/motor from the driving device, the position control and the pressure control can be performed (reversible control is possible) during the lowering process and the rising process.

In a die cushion device in accordance with yet another aspect of the present invention, it is preferable that the driving device is an electric servo motor coupled to the drive shaft of the hydraulic pump/motor. Accordingly, it is possible to perform control in quick response to a command by torque control of the electric servo motor.

In a die cushion device in accordance with yet another aspect of the present invention, it is preferable that the driving device is composed of a both tilting variable capacitor type hydraulic pump/motor coupled to the drive shaft of the hydraulic pump/motor, and a hydraulic supply unit that supplies liquid at a substantially constant pressure to one side port of the both tilting variable capacitor type hydraulic pump/motor. Accordingly, it is possible to transmit desired rotational driving force to the drive shaft of the hydraulic pump/motor with a more inexpensive device than the electric servo motor.

In a die cushion device in accordance with yet another aspect of the present invention, it is preferable that the hydraulic supply unit is composed of an accumulator connected to the one side port of the both tilting variable capacitor type hydraulic pump/motor, a hydraulic pump that supplies pressure liquid to the accumulator, and an electric motor coupled to the drive shaft of the hydraulic pump. Accordingly, it is possible to regenerate kinetic energy of the hydraulic cylinder, or energy retained by pressure liquid of the hydraulic cylinder, during deceleration of the cushion pad in position control by the position controller, or during reduction in pressure in the die cushion pressure generation chamber of the hydraulic cylinder in pressure control by the pressure controller, as pressure oil accumulated in the accumulator.

In a die cushion device in accordance with yet another aspect of the present invention, it is preferable that there is provided an angular speed detector that detects an angular speed of the drive shaft of the hydraulic pump/motor, and preferable that each of the position controller and the pressure controller uses a signal of the angular speed detected by the angular speed detector as a feedback signal of an angular speed, for ensuring the position of the cushion pad and dynamic stability of pressure in the die cushion pressure generation chamber of the hydraulic cylinder.

The invention in accordance with yet another aspect is a control method of a die cushion device that includes: a cushion pad; a hydraulic cylinder that moves the cushion pad up and down; a hydraulic machine that supplies pressure liquid to a die cushion pressure generation chamber of the hydraulic cylinder; a die cushion position detector that detects a position of the cushion pad; a pressure detector that detects pressure in the die cushion pressure generation chamber of the hydraulic cylinder; a first command unit that outputs a first command showing a position of the cushion pad; a second command unit that outputs a second command showing pressure in the die cushion pressure generation chamber of the hydraulic cylinder or a physical amount in proportion to the pressure; a position controller that controls the hydraulic machine so as to cause the position of the cushion pad to correspond to the first command, on the basis of the first command outputted from the first command unit and the position of the cushion pad detected by the die cushion position detector; and a pressure controller that controls the hydraulic machine so as to cause the pressure in the die cushion pressure generation chamber of the hydraulic cylinder to correspond to the second command, on the basis of the second command outputted from the second command unit and the pressure detected by the pressure detector, and in the control method, at least pressure control by the pressure controller is performed during a lowering process of a slide of a press machine, as well as position control by the position controller and pressure control by the pressure controller are switched during a rising process of the slide of the press machine.

In a control method of a die cushion device in accordance with yet another aspect of the present invention, it is preferable to perform the following steps of: performing position control by the position controller until the slide reaches a predetermined die cushion standby position of the cushion pad or a position close thereto during the lowering process of the slide of the press machine; switching to pressure control by the pressure controller when the slide reaches the predetermined die cushion standby position of the cushion pad or a position close thereto, and performing the pressure control until the slide reaches bottom dead center; switching to position control by the position controller when the slide reaches the bottom dead center; setting a first command outputted from the first command unit at a value close to the bottom dead center; gradually increasing the first command to a predetermined value after elapse of a predetermined time from the setting of the first command; subsequently switching to pressure control by the pressure controller; and switching to position control by the position controller after pressurizing for a predetermined time.

It is preferable that the value close to the bottom dead center is slightly smaller than the bottom dead center, and preferable that the predetermined time for which position control is performed by using the value close to the bottom dead center is a time required for eliminating die cushion pressure. In addition, the first command is gradually increased to the predetermined value to enable forming while the cushion pad is raised to a predetermined position.

In a control method of a die cushion device in accordance with yet another aspect of the present invention, it is preferable to perform the following steps of: performing position control by the position controller until the slide reaches a predetermined die cushion standby position of the cushion pad or a position close thereto; switching to pressure control by the pressure controller when the slide reaches the predetermined die cushion standby position of the cushion pad or a position close thereto, and performing the pressure control until the slide reaches bottom dead center; switching to position control by the position controller when the slide reaches the bottom dead center; setting a first command outputted from the first command unit at a value close to the bottom dead center; switching to pressure control by the pressure controller after elapse of a predetermined time from the setting of the first command; subsequently causing the slide to start rising during the rising process of the slide of the press machine; maintaining the pressure control until the slide reaches at least a predetermined slide position; and switching to position control by the position controller after the slide reaches the predetermined slide position, or after elapse of a predetermined time from time when the slide reaches the predetermined slide position.

According to the present invention, it is possible to perform pressure control of a cushion pad during a rising process of a slide of a press machine to enable press forming during the pressure control without resulting in an increase in size of a device and resulting in a high price of the device. As a result, two times of press forming per one press cycle can be achieved to enable efficiency of the press forming to be improved.

BRIEF DESCRIPTION OF THE DRAWINGS

FIG. 5 shows a second embodiment of the control method of the die cushion device;

FIGS. 6A to 6C show a second embodiment of the control method of the die cushion device.

DETAILED DESCRIPTION OF THE EXEMPLARY EMBODIMENTS

With reference to the accompanying drawings, preferable embodiments of a die cushion device and a control method of the die cushion device in accordance with the present invention will be described in detail.

First Embodiment of Die Cushion Device

Figure 1:
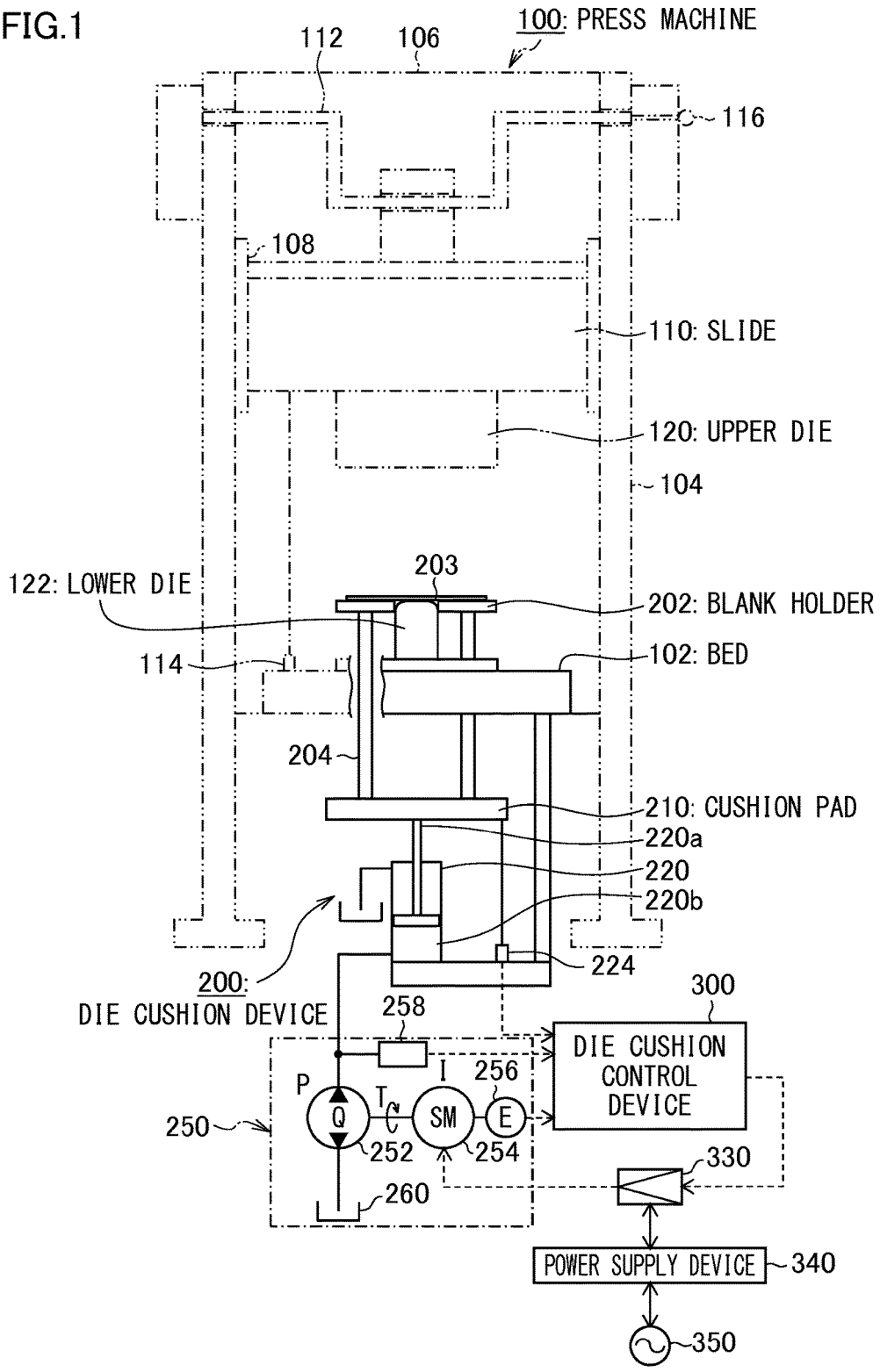
FIG. 1 is a structural view showing a first embodiment of a die cushion device in accordance with the present invention.

FIG. 1 is a structural view showing a first embodiment of a die cushion device in accordance with the present invention. In FIG. 1, a press machine 100 is shown by a dashed-two dotted line, and a die cushion device 200 is shown by a solid line.

The press machine 100 shown in FIG. 1 includes a frame that is composed of a bed 102, a column 104, and a crown 106, and a slide 110 that is movably guided in a vertical direction by a guide section 108 provided in the column 104. The slide 110 is moved in a vertical direction in FIG. 1 by a crank mechanism including a crankshaft 112 to which rotational driving force is transmitted by drive means (not shown).

The press machine 100 is provided on its bed 102 side with a slide position detector 114 that detects a position of the slide 110, and the crankshaft 112 is provided with a crankshaft encoder 116 that detects each of an angular speed and an angle of the crankshaft 112.

An upper die 121 is mounted on the slide 110, and a lower die 122 is mounted on the bed 102 (on a bolster 19 thereof).

A blank holder (blank holding plate) 202 is arranged in a space between the upper die 121 and the lower die 122 so that a lower side thereof is supported by a cushion pad 210 through a plurality of cushion pins 204 and a material 203 is set on (brought into contact with) an upper side thereof.

(Structure of Die Cushion Device)

The die cushion device 200 includes: the blank holder 202; the cushion pad 210 that supports the blank holder 202 through the plurality of cushion pins 204; a hydraulic cylinder (liquid pressure cylinder) 220 that supports the cushion pad 210 to cause die cushion force to be generated in the cushion pad 210; a hydraulic machine (liquid pressure machine) 250 that supplies pressure oil to the hydraulic cylinder 220; and a die cushion control device 300 that controls a hydraulic machine 250.

The hydraulic cylinder 220 and the hydraulic machine 250 serve as a cushion pad lifting unit that causes the cushion pad 210 to perform lifting operation, as well as serve as a die cushion force generation unit that causes die cushion force to be generated in the cushion pad 210.

In addition, there is provided a die cushion position detector 224 that detects a position of a piston rod 220*a* of the hydraulic cylinder 220 in an extending direction with respect to the hydraulic cylinder 220, as a position of the cushion pad 210 in a lifting direction of the cushion pad 210. The die cushion position detector may be provided in a space between the bed 102 and the cushion pad 210.

Next, a configuration of the hydraulic machine 250 that drives the hydraulic cylinder 220 will be described.

The hydraulic machine 250 includes: a hydraulic pump/motor (liquid pressure pump/motor) 252; an electric servo motor 254 connected to a rotating shaft of the hydraulic pump/motor 252; an angular speed detector 256 that detects an angular speed (motor angular speed ω) of a drive shaft of the electric servo motor 254; and a pressure detector 258.

One port (discharge port) of the hydraulic pump/motor 252 is connected to a die cushion pressure generation chamber (lower chamber) 220*b* of the hydraulic cylinder 220, and the other port is connected to a tank 260.

The pressure detector 258 detects pressure acting in the lower chamber 220*b* of the hydraulic cylinder 220, and the angular speed detector 256 detects an angular speed of the drive shaft of the electric servo motor 254.

(Principle of Die Cushion Force Control)

Since die cushion force can be expressed by the product of pressure in the lower chamber 220*b* of the hydraulic cylinder 220 and the area of a cylinder, control of the die cushion force means controlling the pressure in the lower chamber 220*b* of the hydraulic cylinder 220.

Here, the following expressions hold:

$$T=k_a \cdot I \tag{1}$$

$$P=k_2 \cdot T \tag{2}$$

$$P=k_2 \cdot k_a \cdot I=k_4 \cdot I \tag{3}$$

where P is die cushion pressure, T is servo motor torque, I is a driving current of the electric servo motor, and each of $k_a$, $k_2$, and $k_4$ is a proportion constant.

As shown in the expression (3), the die cushion pressure P is proportional to the driving current of the electric servo motor 254. Thus, the die cushion pressure P can be controlled by controlling an electric current I to be applied to the electric servo motor 254.

(Die Cushion Control Device)

Figure 2:
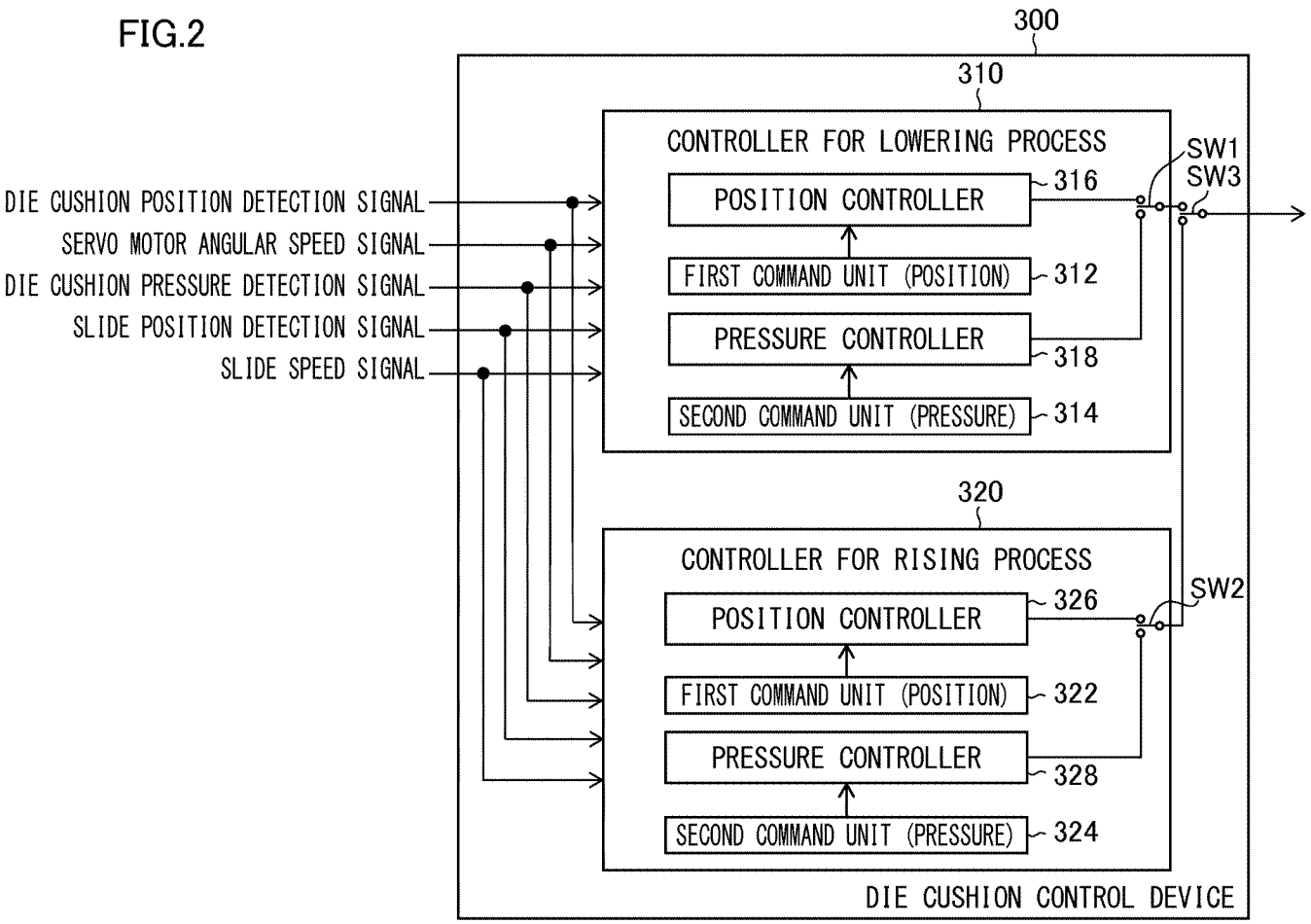
FIG. 2 is a block diagram showing an embodiment of a die cushion control device in the die cushion device.

FIG. 2 is a block diagram showing an embodiment of the die cushion control device 300 in the die cushion device 200.

The die cushion control device 300 includes a controller 310 for the slide 110 during a lowering process, and a controller 320 therefor during a rising process. The controller 310 for a lowering process includes: a first command unit 312 that commands a die cushion position; a second command unit 314 that commands die cushion pressure; a position controller 316 that controls the die cushion position; and a pressure controller 318 that controls the die cushion pressure. The controller 320 for a rising process includes: a first command unit 322 that commands a die cushion position; a second command unit 324 that commands die cushion pressure: a position controller 326 that controls the die cushion position; and a pressure controller 328 that controls the die cushion pressure.

In addition, the die cushion control device 300 includes switched SW1 to SW3. The switch SW1 switches between position control by the position controller 316 for a lowering process and pressure control by the pressure controller 318 for a lowering process. The switch SW2 switches between position control by the position controller 326 for a rising process and pressure control by a pressure controller 328 for a rising process. In addition, the switch SW3 switches between control by the controller 310 for a lowering process and control by the controller 320 for a rising process.

The controller 310 for a lowering process and the controller 320 for a rising process are not limited to controllers that are physically separated, and a common controller may be configured to output different commands between the lowering process and the rising process (a die cushion position command and a die cushion pressure command).

Each of the controller 310 for a lowering process and the controller 320 for a rising process receives a die cushion position detection signal showing a die cushion position (cushion pad position) detected by the die cushion position detector 224, a servo motor angular speed signal detected by the angular speed detector 256, and a pressure detection signal detected by the pressure detector 258. Then, on the basis of these received signals, each of the controller 310 for a lowering process and the controller 320 (die cushion control device 300) during a rising process outputs a die cushion position command to control a die cushion position (position of the cushion pad 210) and a die cushion pressure command to control die cushion pressure by switching between the commands through the switches SW1 to SW3.

(Control of Die Cushion Position)

Each of the first command unit 312 of the controller 310 for a lowering process and the first command unit 322 of the controller 320 for a rising process receives a die cushion position detection signal showing a die cushion position (cushion pad position) from the die cushion position detector 224 to use the signal for generating an initial value in generation of a position command.

The first command unit 312 for a lowering process mainly outputs a die cushion position command for control of a die cushion position (position of the cushion pad 210) in order to cause the cushion pad 210 to stand by at a die cushion standby position that is an initial position.

The first command unit 322 for a rising process mainly outputs a die cushion position command for control of a die cushion position in order to hold the cushion pad 210 at a position of the bottom dead center, and to subsequently perform knockout operation of a product as well as to cause the cushion pad 210 to stand by at the die cushion standby position.

In a case of a die cushion position control state, the position controller 316 for a lowering process outputs a control signal for controlling the electric servo motor 254 on the basis of a die cushion position command outputted from the first command unit 312 and a die cushion position detection signal detected by the die cushion position detector 224. Likewise, the position controller 326 for a rising process outputs a control signal for controlling the electric servo motor 254 on the basis of a die cushion position command outputted from the first command unit 322 and the die cushion position detection signal detected by the die cushion position detector 224.

The control signal outputted from the position controller 316 or 326 is outputted to the electric servo motor 254 through an amplifier 330, as shown in FIG. 1, to control drive of the electric servo motor 254. The hydraulic pump/motor 252 whose drive shaft is connected to the electric servo motor 254 is rotated by driving torque applied by the electric servo motor 254 to supply pressure oil to the lower chamber 220*b* of the hydraulic cylinder 220, or to discharge the pressure oil from the lower chamber 220*b*.

Accordingly, a position of the piston rod 220*a* of the hydraulic cylinder 220 in an extending direction (or a position of the cushion pad 210 in a lifting direction (die cushion position)) is controlled. It is preferable that each of the position controllers 316 and 326 controls speed of the electric servo motor 254 by using an angular speed signal of the drive shaft of the electric servo motor 254 detected by the angular speed detector 256 to secure dynamic stability to perform position control of the cushion pad 210 in the lifting direction.

In addition, during deceleration of the cushion pad 210 in position control by each of the position controllers 316 and 326, torque in a direction opposite to a rotation direction for braking is applied to the hydraulic pump/motor 252 so that the electric servo motor 254 serves as a generator. Electric power generated by the electric servo motor 254 is regenerated in an alternating current power source 350 through the amplifier 330 (serving as an amplifier and a PWM (pulse width modulation) controller) and a power supply device 340 with a function of regenerating electric power. Accordingly, it is possible to save energy of the die cushion device 200.

(Control of Die Cushion Pressure)

Each of the second command unit 314 of the controller 310 for a lowering process and the second command unit 324 of the controller 320 for a rising process receives a slide position detection signal showing a slide position detected by the slide position detector 114, or a slide position detection signal showing a slide position calculated from a detection signal of the crankshaft encoder 116, in order to output a die cushion pressure command corresponding to the slide position.

In a case of the present example, each of the second command units 314 and 324 outputs a stepwise die cushion pressure command as described later to control output timing and the like of the die cushion pressure command on the basis of the slide position detection signal.

Each of the second command unit 314 of the controller 310 for a lowering process and the second command unit 324 of the controller 320 for a rising process receives a die cushion position detection signal showing a die cushion position from the die cushion position detector 224 in order to output a die cushion pressure command corresponding to the die cushion position.

In a case of a die cushion pressure control state, the pressure controller 318 for a lowering process receives a die cushion pressure detection signal showing pressure in the lower chamber 220*b* of the hydraulic cylinder 220, detected by the pressure detector 258, in order to control die cushion pressure in accordance with the die cushion pressure command issued from the second command unit 314 to output a control signal for controlling the electric servo motor 254 on the basis of a die cushion pressure command outputted from the second command unit 314 and a die cushion pressure detection signal detected by the pressure detector 258. Likewise, the pressure controller 328 for a rising process outputs a control signal for controlling the electric servo motor 254 on the basis of a die cushion pressure command outputted from the second command unit 324 and the die cushion pressure detection signal detected by the pressure detector 258.

In addition, each of the pressure controllers 318 and 328 receives a servo motor angular speed signal showing an angular speed of the drive shaft of the electric servo motor 254 (a servo motor angular speed (ω)) detected by the angular speed detector 256 to use the signal as an angular speed feedback signal for securing dynamic stability of die cushion pressure.

Further, each of the pressure controllers 318 and 328 receives a slide speed signal calculated from a detection signal detected by the crankshaft encoder 116 to use the signal as an angular speed feedback signal for correcting die cushion pressure.

When the switches SW1 and SW2 switch the die cushion position control state to the die cushion pressure control state for the pressure controllers 318 and 328, respectively, each of the pressure controllers 318 and 328 outputs a torque command calculated by using the die cushion pressure command, the die cushion pressure detection signal, the servo motor angular speed signal, and the slide speed signal, to the electric servo motor 254 through the amplifier 330 to control die cushion pressure.

At the time of pressure control by the pressure controller 318 during descending in a lowering process, the hydraulic pump/motor 252 serves as a hydraulic motor, and the electric servo motor 254 is driven by the hydraulic pump/motor 252 serving as the hydraulic motor to serve as a generator. In addition, at the time of pressure control by the pressure controller 328 in a case where pressure is reduced during a stop in a rising process, the electric servo motor 254 serves as a generator. Electric power generated by the electric servo motor 254 is regenerated in the alternating current power source 350 through the amplifier 330 (serving as an amplifier and a PWM controller) and the power supply device 340 with a function of regenerating electric power. Accordingly, it is possible to save energy of the die cushion device 200.

The present invention enables the pressure controller 318 for a lowering process to control die cushion pressure during the lowering process of the slide 110, as well as the pressure controller 328 for a rising process to control die cushion pressure during the rising process thereof, so that two times of press forming per one cycle can be performed as described later.

(Control Method of Die Cushion Device)

Each of FIGS. 3 and 4A-4C shows a first embodiment of a control method of the die cushion device 200 configured as above.

Figure 3:
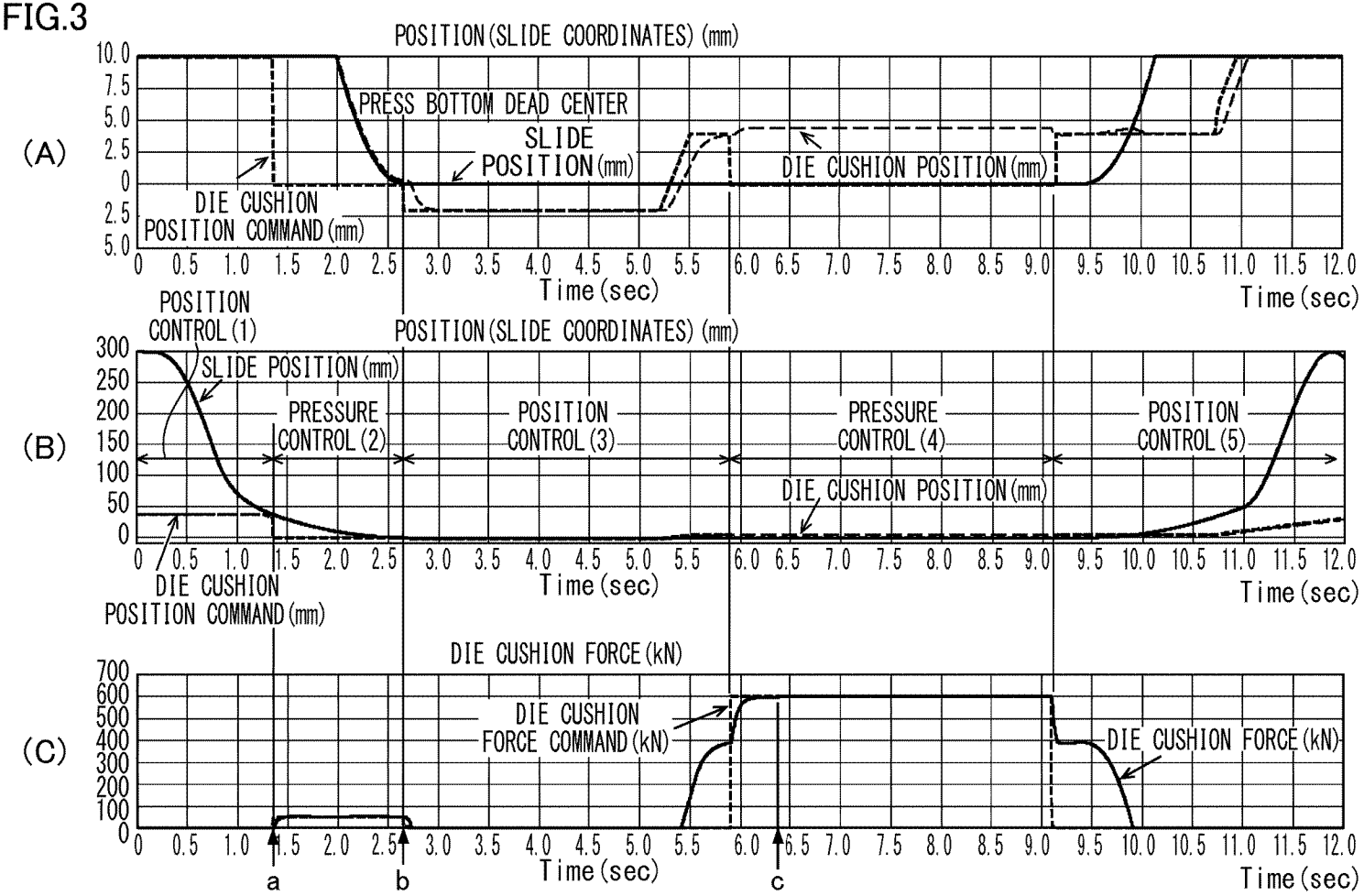
FIG. 3 is a waveform chart showing a slide position, a die cushion position, die cushion force, and the like, used for describing a first embodiment of a control method of the die cushion device.

Each of Portions (A) and (B) of FIG. 3 is a waveform chart showing a die cushion position, a slide position, and a die cushion position command, and Portion (A) of FIG. 3 is an enlarged view of the waveform chart shown in Portion (B) of FIG. 3, enlarged in a vertical axial direction. Portion (C) of FIG. 3 is a waveform chart showing a die cushion force (pressure) command and die cushion force (pressure).

Figure 4A:
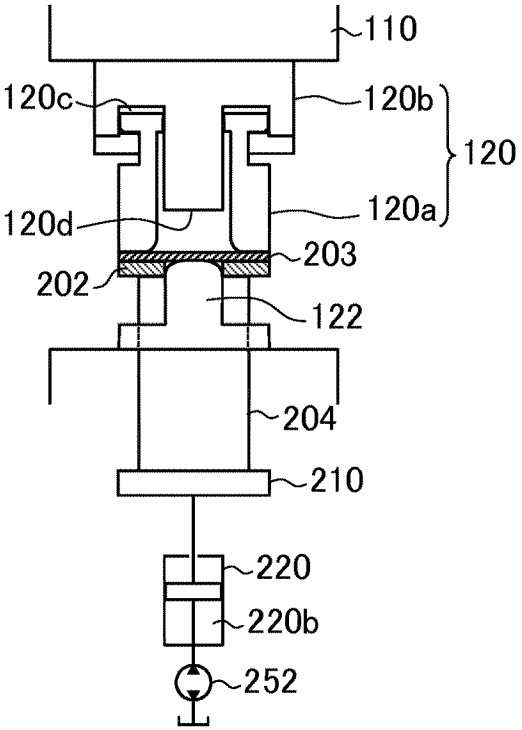
FIGS. 4A to 4C show a main section of the die cushion device at each of time points a, b, and c, shown in FIGS. 3A to 3C.
Figure 4B:
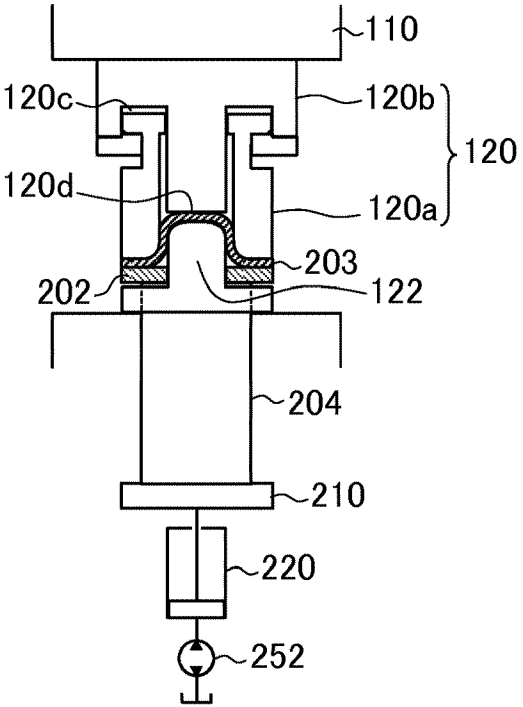
Figure 4C:
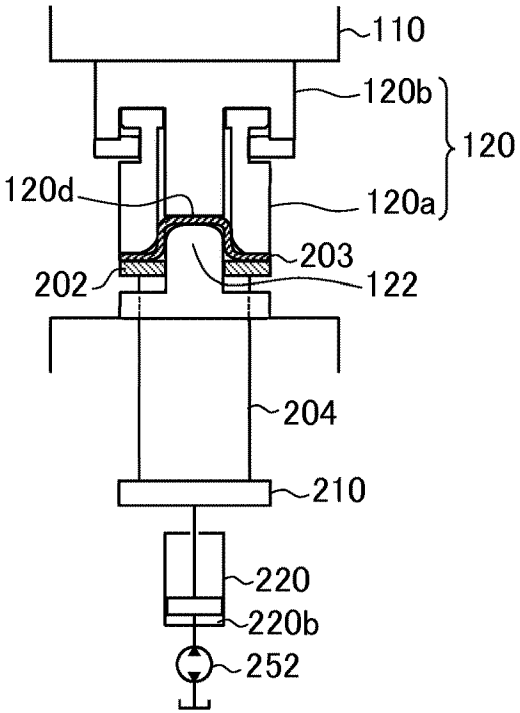

In addition, FIGS. 4A, 4B, and 4C show main sections of a die cushion device and dies (and the upper die 120 and the lower die 122) at time points a, b, and c, shown in FIG. 3, respectively.

The upper die 120 of the first embodiment includes a movable dice 120*a* whose upper portion serves as a piston in a cylinder chamber 120*c*, and a cylinder block 120*b* that drives the movable dice 120*a*, so that pressure oil can be supplied to the cylinder chamber 120*c* in the cylinder block

120*b*. In addition, the cylinder block 120*b* is provided with a pressing portion 120*d* that projects inside the movable dice 120*a*. The upper die 120 (cylinder block 120*b*) is attached to the slide 110. The lower die 122 is a punch projecting upward that is to be inserted into the movable dice 120*a* in a hollow cup shape.

In the present example, the material 203 is formed into a cup shape by drawing. Thus, a sufficient size of each of a curvature (R) of a corner of a lower surface of the movable dice 120*a* of the upper die 120, and an R of a corner of an upper surface of the punch of the lower die 122, is secured to facilitate deep drawing.

In a beginning of a cycle (a period until the slide 110 during a lowering process impacts the material 203), control switches to position control (1) (position control for a lowering process), and then the cushion pad 210 is controlled to be positioned at a standby position (a slide position at which die cushion starts in a press/slide stroke). The material 203 is held (set) on the blank holder 202 supported by the cushion pins 204 provided on the cushion pad 210 interlocking with the piston rod 220*a* of the hydraulic cylinder 220, the cushion pad 210 being controlled to be positioned at the standby position.

In a lowering process of the slide 110, control switches from the position control (1) by the position controller 316 to pressure control (2) by the pressure controller 318 in the controller 310 for a lowering process by using the switch SW1 at the time point a at which the slide 110 reaches a slide position at which die cushion starts, and then, a control signal for controlling die cushion pressure is outputted through the switches SW1 and SW3 so that drawing (first forming) starts among the upper die 120 attached to the slide 110, the material 203 held on the blank holder 202, and the lower die 122 fixed to a bolster (refer to FIG. 4A).

In this state, pressure oil under high pressure is supplied to the cylinder chamber 120*c* in the upper die 120, and sufficiently larger force than maximum acting force of the hydraulic cylinder 220 is applied to the movable dice 120*a* so that the movable dice 120*a* is positioned at the lower limit position within a movable range.

In a process from this moment to a time at which the slide 110 reaches bottom dead center of a press, pressure control is performed so that pressure in the lower chamber 220*b* of the hydraulic cylinder 220 follows a pressure command (first pressure command) outputted from the second command unit 314, corresponding to predetermined die cushion force required for primarily drawing forming (refer to Portions (B) and (C) of FIG. 3).

When the slide 110 reaches the bottom dead center (at the time point b, and refer to FIG. 4B), the first pressure command for the hydraulic cylinder 220 is changed to zero, so that pressure in the lower chamber 220*b* of the hydraulic cylinder 220 is eliminated. When elimination of the pressure is completed (pressure decreases to a predetermined small value close to zero), control switches from the pressure control (2) by the pressure controller 318 to position control (3) by the position controller 326, and then the position control is performed so that the cushion pad 210 is positioned at the bottom dead center or a position smaller by 2 mm than the bottom dead center (refer to Portion (A) of FIG. 3) to completely eliminate the pressure in the lower chamber 220*b* of the hydraulic cylinder 220 (locking action at the bottom dead center).

When the drawing (first forming) is completed, a shape of a product is a rounded shape as a whole because R of each of upper and lower sides of a cup cylindrical portion is large (refer to a shape of the material 203 shown in FIG. 4B).

In addition, when the slide 110 reaches the bottom dead center, the press machine 100 maintains a state where the slide 110 is stopped at the bottom dead center, and eliminates hydraulic pressure applied to the cylinder chamber 120*c* of the cylinder block 120*b* to hold the movable dice 120*a* at the lower limit position.

Next, a die cushion position command is gradually changed from a position command of 2 mm below the bottom dead center to a position command of about 4 mm above the bottom dead center, and then the position controller 326 performs position control on the basis of the die cushion position command to cause a die cushion position of the cushion pad 210 to rise to a position (Sx) that is about 4 mm above the bottom dead center (refer to Portion A of FIG. 3). About 4 mm is equivalent to a stroke of the movable dice 120*a*.

In this (rising by about 4 mm from the bottom dead center) process, the movable dice 120*a* is positioned at almost upper limit of a movable range, and an edge portion of the product held between the pressing portion 120*d* of the cylinder block 120*b* and the lower die 122 rises together with the blank holder 202 (movable dice 120*a*). The edge portion rises so that second forming (compression) is performed for the product. Accordingly, the corner of the rounded product is gradually changed to an edge shape.

When a stroke of about 4 mm of the slide 110 is finished (in the present example, at the time point c at which the slide 110 rises by 3.7 mm from the bottom dead center), control switches from the position control (3) by the position controller 326 for a rising process to pressure control (4) by the pressure controller 328, and then pressure control is performed so that pressure follows a pressure command (second pressure command) in a rising direction. Accordingly (shape fixation of the product), the corner of the product is further close to a right angle shape (refer to FIG. 4C).

After the pressure control (4) is performed for a predetermined time, the second pressure command for the hydraulic cylinder 220 is changed to zero, so that pressure in the lower chamber 220*b* of the hydraulic cylinder 220 is eliminated. When elimination of the pressure is completed (pressure decreases to a predetermined small value close to zero), control switches from the pressure control (4) by the pressure controller 328 for a rising process to position control (5) by the position controller 326, and then the position control (a locking action at a position of 4 mm (Sx)) is performed so that the hydraulic cylinder 220 holds the cushion pad 210 at the position (about 4 mm above the bottom dead center).

After then, the slide 110 quickly rises (refer to Portion (A) of FIG. 3), and after the slide 110 starts rising from the bottom dead center, the blank holder 202 that is indirectly held by the hydraulic cylinder 220 rises after waiting for a predetermined time so as not to interfere with the upper die 120 (by the position control (5)). At that time, the product is removed from the lower die (is knocked out).

FIGS. 5 and 6A-6C show a second embodiment of the control method of the die cushion device 200 configured as above.

In FIG. 5, there is shown a waveform chart that shows a slide position, a die cushion position, and die cushion force (pressure), in a press cycle. In addition, FIGS. 6A, 6B, and 6C show main sections of the die cushion device 200 and dies (the upper die 121 and the lower die 122) at the time of forming in the following case where: the slide 110 is impacted; the slide 110 is at the bottom dead center; and the slide 110 is in a rising process, respectively.

Unlike the structure of the upper die 120 shown in FIGS. 4A to 4C, the upper die 121 is composed of a hollow cup-shaped dice 121*a* closed upward, and a cylinder block 121*d* including a hydraulic cylinder 121*c* that drives a pad 121*b*, which are coupled with each other, so that the pad 121*b* can be vertically moved in the dice 121*a* by driving the hydraulic cylinder 121*c*. In addition, the lower die 122 is a punch projecting upward that is to be inserted into the hollow cup-shaped dice 121*a* in a hollow cup shape.

The material 203 is formed into a cup shape by drawing with the upper die 121 and the lower die 122 as described below. Thus, a sufficient size of each of a curvature (R) of a corner of a lower surface of the dice 121*a*, and an R of a corner of an upper surface of the punch of the lower die 122, is secured to facilitate deep drawing.

In a beginning of a cycle (a period until the slide 110 during a lowering process impacts the material 203), control switches to position control (position control for a lowering process), and then the cushion pad 210 is controlled to be positioned at a standby position (a slide position at which die cushion starts in a press/slide stroke). The material 203 is held (set) on the blank holder 202 supported by the cushion pins 204 provided on the cushion pad 210 interlocking with the piston rod 220*a* of the hydraulic cylinder 220, the cushion pad 210 being controlled to be positioned at the standby position.

In a lowering process of the slide 110, control switches from the position control by the position controller 316 to pressure control by the pressure controller 318 in the controller 310 for a lowering process by using the switch SW1 at the time when the slide 110 reaches a slide position at which die cushion starts (at the time of impact shown in FIG. 6A), and then, a control signal for controlling die cushion pressure is outputted through the switches SW1 and SW3 so that drawing starts among the upper die 121 attached to the slide 110, the material 203 held on the blank holder 202, and the lower die 122 fixed to a bolster.

In a process from this moment to a time at which the slide 110 reaches bottom dead center of a press, pressure control is performed so that pressure in the lower chamber 220*b* of the hydraulic cylinder 220 follows a pressure command (first pressure command) outputted from the second command unit 314, corresponding to predetermined die cushion force required for primarily drawing forming (refer to a forming period (a) shown in FIG. 5).

When the slide 110 reaches the bottom dead center as shown in FIG. 6B, the first pressure command for the hydraulic cylinder 220 is changed to zero, so that pressure in the lower chamber 220*b* of the hydraulic cylinder 220 is eliminated. When elimination of the pressure is completed (pressure decreases to a predetermined small value close to zero), control switches from the pressure control by the pressure controller 318 to position control by the position controller 326, and then the position control is performed so that the cushion pad 210 is positioned the bottom dead center or at a position smaller by 1 mm than a position of the bottom dead center of the slide to completely eliminate the pressure in the hydraulic cylinder 220 (locking action at the bottom dead center).

At that time, a shape of a product is a rounded shape as a whole because R of each of upper and lower sides of a cup cylindrical portion is large (refer to a shape of the material 203 shown in FIG. 5B).

At the bottom dead center of press/slide, the hydraulic cylinder 121*c* is subsequently driven to apply downward force F1 to the pad 121*b* that slides in the dice 121*a* and to hold the force. Accordingly, an upper end of the product is sandwiched between the pad 121*b* and the punch of the lower die 122 in a state where the force F1 is applied from the pad 121*b*. Here, detailed description of the drive of the hydraulic cylinder 121*c* is omitted.

Next, control switches from the position control by the position controller 326 for a rising process to pressure control by the pressure controller 328, and then the pressure control is performed so that pressure in the lower chamber 220*b* of the hydraulic cylinder 220 follows a pressure command (second pressure command) corresponding to upward force F2 that is smaller by about 10% to 20% than the force F1. At that time, the cushion pad 210 rises a little (an amount smaller than the Sx), so that upper and lower R shape portions of the product are deformed so as to slightly become close to a right angle shape.

In a beginning of a rising process of the slide 110, the slide 110 rises by a slight amount of a stroke of the Sx at a very slow speed in a state where the forces F1 and F2 are applied, and then stops at a position at which the slide 110 rises by the amount of the Sx. The Sx is a shrinkage of a height dimension of the product for allowing the upper and lower R shape portions of the product to be deformed into a right angle shape. In addition, although a position and a speed of the slide 110 can be controlled on the basis of a slide position detected by the slide position detector 114, or an angle or an angular speed of the crankshaft 112 detected by the crankshaft encoder 116, a detailed description of the control is omitted here.

When the slide 110 rises at a very slow speed, a cylindrical outer side surface of the product is pulled upward by frictional force between an inner side surface of the dice 121*a* of the upper die 121 that is rising at the very slow speed and the outer side surface of the product, and a cylindrical inner side surface of the product that is rising at the very slow speed is pulled downward by frictional force between an outer surface of the punch of the lower die 122 and the inner side surface of the product, whereby the R shape of each of the upper and lower portions of the product is deformed during the slight stroke while deformation into a right angle shape is facilitated (refer to a forming period (b) shown in FIG. 5).

Then, while the slide 110 is stopped at an Sx rising position, the product is held in a state where the forces F1 and F2 are applied to the product from above and below, respectively, for a predetermined time, to wait for shape fixation of the product (refer to a forming period (c) shown in FIG. 5). In this way, during rising operation of the hydraulic cylinder 220 (while the slide 110 is rising), enabling pressure corresponding to a predetermined force F2 (following the second pressure command) to be controlled is also one of the features of the present invention.

After the slide 110 is stopped at a slide position Sx for a predetermined time during a rising process of the slide 110, the second pressure command of the hydraulic cylinder 220, corresponding to the force F2, is changed to zero so that pressure in the lower chamber 220*b* of the hydraulic cylinder 220 is eliminated. When elimination of the pressure is completed (pressure decreases to a predetermined small value close to zero), control switches from the pressure control by the pressure controller 328 to position control by the position controller 326, and then the position control is performed so that the hydraulic cylinder 220 causes the cushion pad 210 to be positioned at a die cushion position smaller by 1 mm than the slide position Sx (locking action at the Sx).

After then, the slide 110 quickly rises, and after the slide 110 starts rising from the slide position Sx, the blank holder 202 that is indirectly held by the hydraulic cylinder 220 rises after waiting for a predetermined time (by position control) so as not to interfere with the upper die 121 (refer to a period (c) shown in FIG. 5). At that time, the product is removed from the lower die 122 (is knocked out).

As described above, pressure control for the cushion pad 210 is performed during a lowering process of the slide 110 to enable press forming (normal press forming) of the material 203, and normal position control for the cushion pad 210 along with pressure control therefor is performed during a rising process of the slide 110 to enable press forming (second press forming) of the material 203, whereby two times of press forming per one press cycle is feasible. In addition, during the rising process, the die cushion device 200 configured as described above is capable of generating die cushion force equivalent to die cushion force that can be generated during the lowering process.

Second Embodiment of Die Cushion Device

Figure 7:
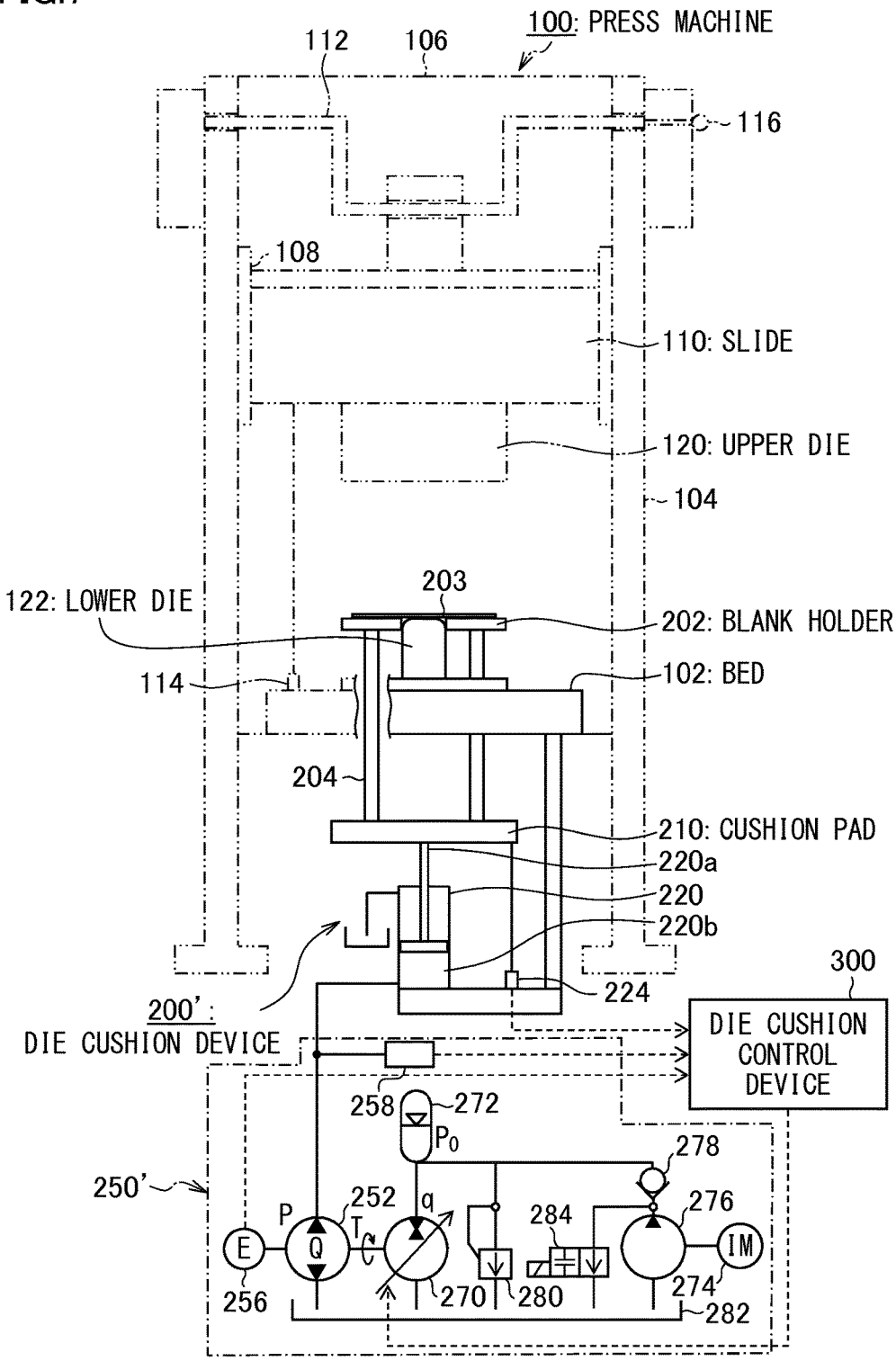
FIG. 7 is a structural view showing a second embodiment of the die cushion device in accordance with the present invention.

FIG. 7 is a structural view showing a second embodiment of a die cushion device in accordance with the present invention. A portion common to that shown in FIG. 1 is designated by the same reference numeral as that of FIG. 1 without duplicated description in detail.

As shown in FIG. 7, a die cushion device 200' of the second embodiment is different from the die cushion device 200 of the first embodiment shown in FIG. 1 in a configuration of a hydraulic machine (hydraulic machine) 250' that supplies pressure oil to the hydraulic cylinder 220.

That is, in the hydraulic machine 250' used in the die cushion device 200' of the second embodiment, instead of the electric servo motor 254 of the first embodiment, a both tilting variable capacitor type hydraulic (hydraulic) pump/motor 270 is coupled to a drive shaft of the hydraulic pump/motor 252.

In addition, an accumulator 272 is connected to a one side port of the both tilting variable capacitor type hydraulic pump/motor 270, and pressure oil is supplied to the accumulator 272 from a hydraulic pump (hydraulic pump) 276 driven by an induction motor (electric motor) 274 through a check valve 278, so that pressure oil under substantially constant pressure is accumulated in the accumulator 272. Further, a relief valve 280 is provided at a position between the accumulator 272 and the check valve 278. The relief valve 280 serves to release the pressure oil to a tank 282 if unexpected abnormal pressure is applied to the accumulator 272. Furthermore, an on-load valve 284 is provided at a position between the hydraulic pump 276 and the check valve 278.

The on-load valve 284 is turned on if pressure of the pressure oil accumulated in the accumulator 272 decreases to a predetermined lower limit value or less, and is turned off if the pressure exceeds the predetermined upper limit value. If the on-load valve 284 is turned on, pressure oil is supplied to the accumulator 272 from the hydraulic pump 276 driven by the induction motor 274 through the check valve 278.

Here, the following expressions hold:

$$(kP_Oq)/2\pi=T\rightarrow T=k_1q \quad (4)$$

$$(kPQ)/2\pi=T\rightarrow P=k_2T \quad (5)$$

$$P=k_1k_2q=k_3q \quad (6)$$

where P is die cushion pressure, T is torque of a both tilting variable capacitor type hydraulic pump/motor, q is displacement volume of the both tilting variable capacitor type hydraulic pump/motor, Q is displacement volume of a hydraulic pump/motor, $P_O$ is pressure of pressure oil accumulated in an accumulator, and each of $k_1$, $k_2$, $k_3$, and k is a constant of proportionality.

As shown in the expression (6), the die cushion pressure P is in proportion to the displacement volume q of the both tilting variable capacitor type hydraulic pump/motor 270. Thus, the die cushion control device 300 controls the displacement volume q (a swash plate (or oblique axis) angle of the both tilting variable capacitor type hydraulic pump/motor 270) of the both tilting variable capacitor type hydraulic pump/motor 270 to enable the die cushion pressure P to be controlled.

In addition, during deceleration of the cushion pad 210 in position control by the die cushion control device 300, or during reduction in pressure in the lower chamber 220*b* of the hydraulic cylinder 220 in pressure control by the die cushion control device 300, torque for braking in a direction opposite to the rotation direction is applied to the hydraulic pump/motor 252 to cause the both tilting variable capacitor type hydraulic pump/motor 270 to serve as a hydraulic pump. The both tilting variable capacitor type hydraulic pump/motor 270 serving as a hydraulic pump supplies pressure oil to the accumulator 272, so that kinetic energy of the hydraulic cylinder 220, or energy retained by pressure oil of the hydraulic cylinder 220, is regenerated as pressure oil accumulated in the accumulator 272. Accordingly, it is possible to save energy of the die cushion device 200'.

The hydraulic pump/motor 252 serves as a hydraulic motor, and the both tilting variable capacitor type hydraulic pump/motor 270 is driven by the hydraulic pump/motor 252 serving as a hydraulic motor to serve as a hydraulic pump. The both tilting variable capacitor type hydraulic pump/motor 270 serving as a hydraulic pump supplies pressure oil to the accumulator 272, so that kinetic energy of the hydraulic cylinder 220, or energy retained by pressure oil of the hydraulic cylinder 220, is regenerated as pressure oil accumulated in the accumulator 272. Accordingly, it is possible to save energy of the die cushion device 200'.

Others

Press forming to be performed during a rising process is not limited to the embodiments above, and a variety of forming is to be considered. In brief, whatever uses die cushion force applied to a cushion pad during a rising process is available.

In addition, although position control for a cushion pad and pressure control therefor are to be switched during a lowering process in the present embodiments, other than the above, only the pressure control of a cushion pad may be performed. In this case, the cushion pad is caused to stand by in contact with a predetermined reference surface at a predetermined pressure at a beginning of a press cycle (caused to be in a pressure control state).

Further, a die cushion pressure command is not limited to a stepwise die cushion pressure command, and may change stepwise, or change like a taper, in accordance with a die cushion position.

The present invention is not limited to the embodiments described above, and therefore, it is needless to say that a variety of modifications are possible within a range without departing from the spirit of the present invention.

What is claimed is:

1. A die cushion device comprising:

a cushion pad;

a hydraulic cylinder that moves the cushion pad up and down;

a hydraulic machine that supplies pressure liquid to a die cushion pressure generation chamber of the hydraulic cylinder;

a die cushion position detector that detects a position of the cushion pad;

a pressure detector that detects pressure in the die cushion pressure generation chamber of the hydraulic cylinder;

a first command unit that outputs a first command showing a position of the cushion pad;

a second command unit that outputs a second command showing pressure in the die cushion pressure generation chamber of the hydraulic cylinder or a physical amount in proportion to the pressure;

a position controller that controls the hydraulic machine so as to cause the position of the cushion pad to correspond to the first command, on the basis of the first command outputted from the first command unit and the position of the cushion pad detected by the die cushion position detector; and a pressure controller that controls the hydraulic machine so as to cause the pressure in the die cushion pressure generation chamber of the hydraulic cylinder to correspond to the second command, on the basis of the second command outputted from the second command unit and the pressure detected by the pressure detector, wherein position control by the position controller and pressure control by the pressure controller are switched during a rising process of a slide of a press machine.

2. The die cushion device according to claim 1, wherein the hydraulic machine enables force equivalent to die cushion force to be generated in the hydraulic cylinder during a rising process of the slide of the press machine.

3. The die cushion device according to claim 1, further comprising: a regenerative device that regenerates kinetic energy, energy required for die cushion force operation, or energy retained by pressure liquid of the hydraulic cylinder, during deceleration of the cushion pad in position control by the position controller, during pressure control by the pressure controller during descending, or during reduction in pressure in pressure control during a stop, through the hydraulic machine.

4. The die cushion device according to claim 1, wherein position control by the position controller and pressure control by the pressure controller are switched during a lowering process of a slide of a press machine.

5. The die cushion device according to claim 1, wherein during a rising process of a slide of a press machine, the pressure controller performs pressure control at least during rising operation of the slide.

6. The die cushion device according to claim 1, wherein the hydraulic machine includes a hydraulic pump/motor whose discharge port is connected to the die cushion pressure generation chamber of the hydraulic cylinder through piping, and a driving device that selectively transmits rotational driving force in a normal rotation direction or a reverse rotation direction to a drive shaft of the hydraulic pump/motor.

7. The die cushion device according to claim 6, wherein the driving device is an electric servo motor coupled to the drive shaft of the hydraulic pump/motor.

8. The die cushion device according to claim 6, wherein the driving device is composed of a both tilting variable capacitor type hydraulic pump/motor coupled to the drive shaft of the hydraulic pump/motor, and a hydraulic supply unit that supplies liquid at a substantially constant pressure to one side port of the both tilting variable capacitor type hydraulic pump/motor.

9. The die cushion device according to claim 8, wherein the hydraulic supply unit is composed of an accumulator connected to the one side port of the both tilting variable capacitor type hydraulic pump/motor, a hydraulic pump that supplies pressure liquid to the accumulator, and an electric motor coupled to the drive shaft of the hydraulic pump.

10. The die cushion device according to claim 6, further comprising an angular speed detector that detects an angular speed of the drive shaft of the hydraulic pump/motor, wherein each of the position controller and the pressure controller uses a signal of the angular speed detected by the angular speed detector as a feedback signal of an angular speed, for ensuring the position of the cushion pad and dynamic stability of pressure in the die cushion pressure generation chamber of the hydraulic cylinder.

11. A control method of a die cushion device comprising:

a cushion pad;

a hydraulic cylinder that moves the cushion pad up and down;

a hydraulic machine that supplies pressure liquid to a die cushion pressure generation chamber of the hydraulic cylinder;

a die cushion position detector that detects a position of the cushion pad;

a pressure detector that detects pressure in the die cushion pressure generation chamber of the hydraulic cylinder;

a first command unit that outputs a first command showing a position of the cushion pad;

a second command unit that outputs a second command showing pressure in the die cushion pressure generation chamber of the hydraulic cylinder or a physical amount in proportion to the pressure;

a position controller that controls the hydraulic machine so as to cause the position of the cushion pad to correspond to the first command, on the basis of the first command outputted from the first command unit and the position of the cushion pad detected by the die cushion position detector; and a pressure controller that controls the hydraulic machine so as to cause the pressure in the die cushion pressure generation chamber of the hydraulic cylinder to correspond to the second command, on the basis of the second command outputted from the second command unit and the pressure detected by the pressure detector, wherein at least pressure control by the pressure controller is performed during a lowering process of a slide of a press machine, as well as position control by the position controller and pressure control by the pressure controller are switched during a rising process of the slide of the press machine.

12. The control method of a die cushion device according to claim 11, wherein there are performed the following steps of:

performing position control by the position controller until the slide reaches a predetermined die cushion standby position of the cushion pad or a position close thereto during the lowering process of the slide of the press machine;

switching to pressure control by the pressure controller when the slide reaches the predetermined die cushion standby position of the cushion pad or a position close thereto, and performing the pressure control until the slide reaches bottom dead center;

switching to position control by the position controller when the slide reaches the bottom dead center;

setting a first command outputted from the first command unit at a value close to the bottom dead center;

gradually increasing the first command to a predetermined value after elapse of a predetermined time from the setting of the first command;

subsequently switching to pressure control by the pressure controller; and switching to position control by the position controller after pressurizing for a predetermined time.

13. The control method of a die cushion device, according to claim 11, wherein there are performed the following steps of:

performing position control by the position controller until the slide reaches a predetermined die cushion standby position of the cushion pad or a position close thereto during the lowering process of the slide of the press machine;

switching to pressure control by the pressure controller when the slide reaches the predetermined die cushion standby position of the cushion pad or a position close thereto, and performing the pressure control until the slide reaches bottom dead center;

switching to position control by the position controller when the slide reaches the bottom dead center;

setting a first command outputted from the first command unit at a value close to the bottom dead center;

switching to pressure control by the pressure controller after elapse of a predetermined time from the setting of the first command;

subsequently causing the slide to start rising during the rising process of the slide of the press machine;

maintaining the pressure control until the slide reaches at least a predetermined slide position; and switching to position control by the position controller after the slide reaches the predetermined slide position, or after elapse of a predetermined time from time when the slide reaches the predetermined slide position.

* * * * *